United States Patent [19]

Kulischenko

[11] 4,334,491

[45] Jun. 15, 1982

[54] GEARLESS POSITION INDICATOR

[75] Inventor: Walter Kulischenko, East Brunswick, N.J.

[73] Assignee: Pennwalt Corporation, Philadelphia, Pa.

[21] Appl. No.: 205,483

[22] Filed: Nov. 10, 1980

[51] Int. Cl.[3] ..... B63H 25/24; B60Q 1/42

[52] U.S. Cl. ..... 116/31; 114/144 R

[58] Field of Search ..... 116/303, 31; 74/89.15

[56] References Cited

U.S. PATENT DOCUMENTS

| | | | |
|---|---|---|---|
| 1,140,229 | 5/1915 | Youngkuist | 116/31 |
| 2,707,451 | 5/1955 | Brink | 116/31 |
| 3,072,091 | 1/1963 | Booth | 116/31 |
| 3,331,350 | 7/1967 | Norton | 116/31 |
| 4,004,537 | 1/1977 | Nilsson | 114/144 R |
| 4,173,937 | 11/1979 | Kulischenko | 114/144 R |

*Primary Examiner*—Daniel M. Yasich

[57] ABSTRACT

Position indicating device for constantly visually indicating angular disposition of the rudder of a marine vessel. The device employs a first ball screw cylinder which converts the linear motion from a second ball screw cylinder into rotary motion, which rotary motion is transmitted by a rotatable flexible shaft to the needle pointer of the device. Linear motion of the second ball screw cylinder is generated when the vessel's steering wheel is turned which rotates another flexible shaft connected to the second ball screw cylinder. Linear motion of the second ball screw cylinder controls the position of the rudder simultaneously with conversion of said linear motion into rotary motion by the first ball screw cylinder.

7 Claims, 5 Drawing Figures

GEARLESS POSITION INDICATOR

STATEMENT OF THE INVENTION

This invention relates to a position indicating device and more particularly to gearless means for constantly visually indicating the angular position of the rudder, for example, on a marine vessel.

BACKGROUND AND SUMMARY OF THE INVENTION

Steering position indicators for automotive vehicles and marine vessels are known for providing a visual indication of the orientation of the steering wheel or rudder. In the steering of marine vessels, for example, under foggy conditions, or where there are no visible reference points, an indication of the angular disposition of the rudder could prove quite helpful.

Prior art indicating devices, in the main, employ gear means which, although generally satisfactory, are rather complicated and expensive. The present device employs a pair of rotatable flexible shafts, each of which coacts with a separate ball screw cylinder. A first cylinder controls the rudder through one of the flexible shafts responsive to turning of the steering wheel. Movement of the first cylinder causes a reverse movement in the other cylinder which is connected to the other flexible shaft which controls the needle pointer of the indicating device at the vessel's helm.

The device is simple to install and maintain, inexpensive, reliable and accurate.

DETAILED DESCRIPTION OF THE INVENTION

Figure 1:
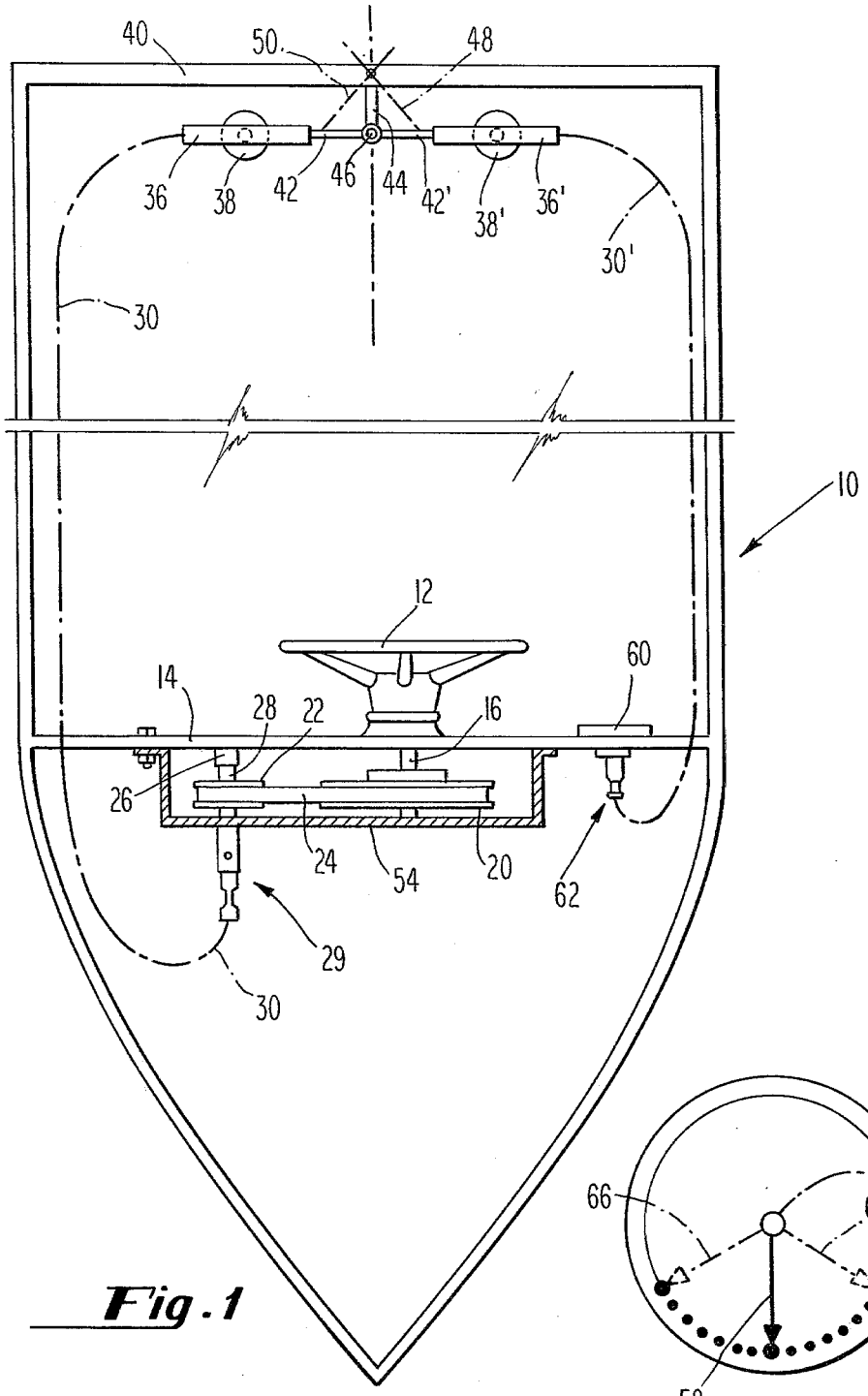
FIG. 1 is a plan view, partially sectioned, of the position indicating device of the present invention employed with a remotely actuated marine vessel steering mechanism.

In FIG. 1, a boat 10 includes a manually operated steering wheel 12 which may be conveniently mounted to dashboard 14. Steering wheel shaft 16 is connected by conventional means to a driver pulley 20 such that one revolution of steering wheel 12 produces a similar revolution of the driver pulley. Driver pulley 20 causes driven pulley 22 to rotate therewith by virtue of a timing belt 24 operably engaged therebetween. Driven pulley 22 is provided with a smaller diameter than driver pulley 20, and thus, a single revolution of the driver pulley will produce a plurality of revolutions of the driven pulley. In the present invention, one complete revolution of steering wheel 12, or driver pulley 20, will cause 4 revolutions of driven pulley 22. The ratio of diameters of the pulleys to achieve these values in readily calculable and is not stated herein.

Driven pulley 22 is journalled, or suitably rotatably mounted to dashboard 14 by pivot bearing 26, for example.

Shaft 28 of driven pulley 22 is connected to rotatable flexible shaft assembly 29 which transmits torque from shaft 28 to a ball screw cylinder 36, pivotable on bracket 38 secured to boat 10 adjacent transom 40. The pulley-belt components may readily be enclosed in a self-contained unit, having means for connecting shaft 28 to rotatable flexible shaft assembly 29, which unit may be screw mounted to dashboard 14. Ball screw cylinder 36 is conventional and converts rotary motion from rotatable flexible shaft 30 to linear motion, which linear motion is transmitted to an output member 42 for controlling a steering arm 44 through pivot link 46. Steering arm 44 moves the outboard motor (not shown) or a rudder or other steering member (also not shown) by conventional means.

Steering arm 44 is illustrated at its mid-travel position. Dotted lines 48 and 50 indicate the positions of steering arm 44 at its end-travel positions. More specifically, when steering wheel 12 is rotated about $1\frac{1}{2}$ revolutions in a clockwise direction, or to the right, steering arm 44 will assume the position indicated by dotted lines 48 causing boat 10 to travel to the right. As aforementioned, ball screw cylinder 36 is conventional and is not shown in detail, but typically comprises a nut, a screw which is rotatable relative to the nut, and a plurality of balls disposed in a closed loop around the inner periphery of the nut. The screw, of course, is free to rotate, but linear movement thereof is restrained. The nut however, connected to output member 42, is restrained from rotating and thus moves linearly as the screw is rotated. Description of ball screw cylinders may be found in U.S. Pat. No. 4,004,537.

Alternatively, dotted lines 50 indicate the position of steering arm 44 when steering wheel 12 is rotated about $1\frac{1}{2}$ revolutions to the left, or counterclockwise, to thus cause boat 10 to travel to the left.

A housing 54, or suitable shrouding member, may enclose the pulley-timing belt mechanism to protect it from dirt, moisture, and the like, unless, of course, a self-contained unit as aforementioned is provided. The pulley-belt system and rotatable flexible shaft assembly are described more fully in U.S. Pat. No. 4,173,937, issued to W. Kulischenko et al for "Remotely Actuated Marine Steering System".

The screw of ball screw cylinder 36 is conveniently pitched at 0.750 inches. Thus, output member 42 will move 3 linear inches per single revolution of steering wheel 12 or driver pulley 20. From its mid-travel position, output member 42 can travel about $4\frac{1}{2}$ inches in either direction, or a total of about 9 linear inches. Thus, three revolutions of steering wheel 12 will move output member 44 from position 50 to position 48, or vice versa.

Another ball screw cylinder 36' is similarly pivotally mounted on bracket 38' on the other side of boat 10. Output member 42' is suitably attached to pivot link 46 such that linear movement of output member 42 produces an equal but opposite movement to output member 42'. Ball screw cylinder 36' however is provided with a screw which is pitched at 36'', i.e., three revolutions of steering wheel 12 will move output members 42 and 42' a total distance of 9 linear inches which will cause rotatable flexible shaft 30' to rotate 90° to thereby rotate the needle pointer 58 (FIG. 2) 90° on indicator 60 through assembly 62. Thus, needle pointer 58 will rotate from position 64 to position 66 when steering wheel 12 is turned clockwise three complete revolutions. Needle pointer 58 points straight downwardly in the neutral position when viewed by the operator. Flexible shaft assembly 62 is conventional and well known and typically comprises any suitable end fitting capable of coupling flexible shaft 30' with needle pointer 58.

Figure 2:
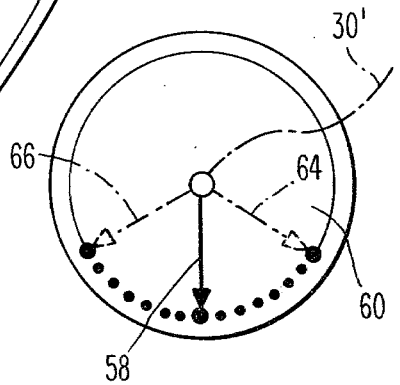
FIG. 2 is a front view of the position indicator.
Figure 3:
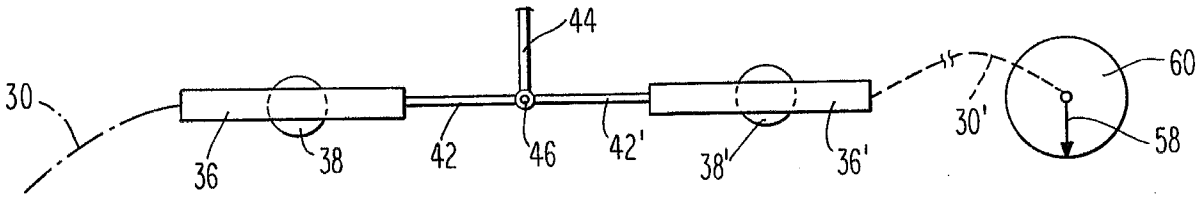
FIG. 3 diagrammatically illustrates neutral position of the rudder and position indicator.
Figure 4:
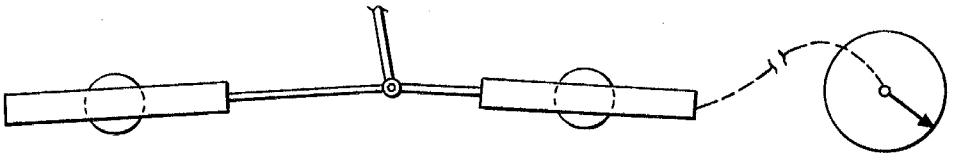
FIGS. 4 and 5 diagrammatically illustrate extreme right and left positions respectively of the rudder and position indicator.
Figure 5:
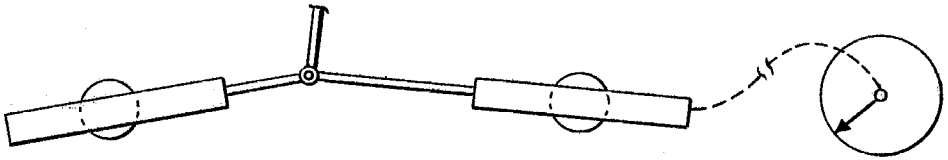

More specifically, and referring additionally to FIGS. 3, 4 and 5, when the rudder is in its mid-position, i.e., steering arm 44 is parallel with the center line or longitudinal axis of boat 10, needle pointer 58 will assume the position shown in FIGS. 2 and 3. If steering wheel 12 is now turned 1½ revolutions clockwise, output member 42 will be fully extended (FIG. 4) and output member 42' will be fully retracted to thus rotate flexible shaft 30' such that needle pointer 58 will assume the position shown. When steering wheel 12 is now rotated three revolutions counterclockwise, member 42 will fully retract and member 42' will be fully extended, and needle pointer 58 will assume the position indicated at 66 in FIG. 2.

In FIGS. 4 and 5, it will be appreciated that each of the ball screw cylinders have pivoted very slightly on its respective bracket member, and that output members 42 and 42' are no longer in perfect alignment. To compensate, in actual practice, 3 complete revolutions of steering wheel 12 will cause the output members to travel slightly in excess of 9 linear inches.

It is further appreciated that the load on flexible shaft 30' is negligible. Thus, even the slightest rotation of the screw of ball screw cylinder 36' will be accurately reflected at the indicator 60.

I claim:

1. In combination with a marine vessel steering system wherein manually-operable steering control means effects rotation of rotatable means for controlling angular disposition of a steering member through pivot means, said steering member connected through first screw means to said steering control means, said first screw means converting rotary motion from said rotatable means to linear motion, said linear motion effecting angular disposition of said steering member which controls direction of travel of said marine vessel, the improvement comprising position indicating means connected to said steering member through a second screw member oppositely arranged and similar to said first screw means for indicating said angular disposition of said steering member, said second screw means connected to said pivot means and responsive to movement of said first screw means for indicating said angular disposition of said steering member on said indicating means.

2. The device of claim 1 wherein said rotatable means is a first rotatable flexible shaft, and said first and second screw means are a first ball screw cylinder and a second ball screw cylinder respectively.

3. The device of claim 1 wherein said position indicating means indicates angular disposition of said steering member with respect to longitudinal axis of said vessel.

4. The device of claim 2 wherein said second ball screw cylinder converts linear motion from said first ball screw cylinder into rotary motion.

5. The device of claim 4 wherein said rotary motion from said second ball screw cylinder is transmitted to a second rotatable flexible shaft which controls a needle pointer on said position indicating means.

6. The device of claim 5 wherein each of said first and second ball screw cylinders is provided with an output member, said output members being in face-to-face relationship and pivotally interconnected, and wherein three complete revolutions of said manually-operable steering control means moves said needle pointer 45° from said longitudinal axis of said vessel to 45° on other side of said longitudinal axis.

7. The device of claim 6 wherein said first ball screw cylinder is provided with a screw pitched at 0.750", and said second ball screw cylinder is provided with a screw pitched at 36".

* * * * *